United States Patent [19]

Klavestad

[11] 4,328,635

[45] May 11, 1982

[54] FIREARM HAVING MULTIPLE BARRELS MOVABLE TOGETHER TO ONE SIDE

[75] Inventor: Osborne Klavestad, Shakopee, Minn.

[73] Assignee: Olde Savannah Arms Company, Savannah, Ga.

[21] Appl. No.: 114,839

[22] Filed: Jan. 24, 1980

Related U.S. Application Data

[63] Continuation of Ser. No. 900,155, Apr. 26, 1978, abandoned.

[51] Int. Cl.[3] ..... F41C 7/10

[52] U.S. Cl. ..... 42/12; 42/42 R

[58] Field of Search ..... 42/12, 40, 42 R, 43, 42/75 D

[56] References Cited

U.S. PATENT DOCUMENTS

| | | | |
|---|---|---|---|
| 182,557 | 9/1876 | Castle | 42/12 |
| 414,213 | 11/1889 | Hall | 42/12 |
| 477,410 | 6/1892 | Grouleff et al. | 42/12 |
| 704,025 | 7/1902 | Fulford | 42/42 R |
| 895,947 | 8/1908 | Blocker | 42/42 R |
| 1,029,374 | 6/1912 | Kremer et al. | 42/75 D |
| 1,816,313 | 7/1931 | Burton | 42/40 |
| 1,834,544 | 12/1931 | Klebe | 42/42 R |
| 2,052,957 | 9/1936 | Wareham | 42/42 R |
| 2,333,043 | 10/1943 | Roemer | 42/43 |
| 2,376,358 | 5/1945 | Horsrud | 42/43 |
| 2,465,432 | 3/1949 | Curci | 42/43 |
| 2,603,021 | 7/1952 | Paulve | 42/75 D |

*Primary Examiner*—Charles T. Jordan

*Attorney, Agent, or Firm*—Jones, Thomas & Askew

[57] ABSTRACT

A firearm having over and under double barrels in a side break arrangement which could be utilized for shotgun, rifle or handgun. A hinge arrangement for the double barrels comprises a cylindrical portion of the hinge on a main frame which detachably mounts to the other portion of the hinge which is part of a mounting bracket that detachably mounts on the barrels. A cocking lever is operated by barrel motion to move a cocking plate with retracts two separate and independent firing pins that are latched into place for selective release by a single trigger operated successively twice. A safety device includes a shifting lever which is automatically operated upon cocking or opening interposed selectively against the trigger to prevent accidental firing.

3 Claims, 16 Drawing Figures

FIREARM HAVING MULTIPLE BARRELS MOVABLE TOGETHER TO ONE SIDE

This is a continuation of application Ser. No. 900,155, filed Apr. 26, 1978, now abandoned.

BACKGROUND OF THE INVENTION

1. Field of the Invention

Multiple barrelled firearms having relative displacement of the barrels for cocking and loading together with means for cocking and releasing multiple separate and independent firing pins for each of said barrels. Also, hinge mechanisms for firearms having moveable barrels to provide limited movement for loading.

2. Description of the Prior Art

Firearms such as rifles and shotguns which have multiple barrels (e.g. 2 side-by-side or 2 over and under barrels) are well known in the art as well as various mechanisms for cocking such firearms and for selectively firing each barrel for ejecting spent cartridges and so forth. For example, double-barrel shotguns are well known both in the side-by-side versions as well as the over and under version. However, both the side-by-side versions and the over and under versions break so that the loading end of the barrels move in a generally upwardly and downwardly path in front of the shooter. Thus, the barrels move along a generally horizontal pivot of some sort. The present device is to be contrasted in that while the barrels are over and under the hinge is generally vertical when the firearm is held in its normal shooting position so that the separation of the loading end of the barrel for loading and unloading is a generally sidebreak operation whereby the loading end of the barrels moves to the side of the shooter with a very slight opening that is very quick. This is a different hinge arrangement from the prior art such as U.S. Pat. Nos. 414,213 issued in 1889 and 477,410 issued in 1892. Although the firearms disclosed in these patents employ generally sidebreak arrangement the present device is very different insofar as the mounting of the barrels and hinge to the stock and frame is concerned as well as a different arrangement in the firing mechanism, safety and the like.

SUMMARY OF THE INVENTION

A firearm employing at least two elongated barrels arranged in an over and under, superposed co-extensive relationship and there being an attachment means on said barrels to receive a detachable mounting bracket which includes a concave portion of the hinge detachably receiving the convex other portion of the hinge which is held in place by a projection fitting into a slot.

A multiple barrelled firearm comprising a support frame upon which there may be mounted a stock or handle and a plurality of connected barrels mounted on said frame, there being a selective firing arrangement comprising individual firing pins mounted for simultaneous movement and latching in cocked position to be released selectively by a successive movement of the same single trigger whereby movement of the trigger disengages one firing pin and the mechanism moves into place to stop the release of the other for subsequent selective release by movement of the trigger.

An object of this invention is to provide a complete multi-barrel firearm, such as a shotgun or rifle, which includes a frame on which is mounted the handle or stock (it being understood that the present firearm may also be made into a handgun) said hinge being detachably mounted by means of a removable hinge bracket.

Other and further objects and advantages of this invention will become apparent upon reading the following description of a preferred embodiment taken in conjunction with the accompanying drawings.

DESCRIPTION OF THE PREFERRED EMBODIMENT

Figure 1:
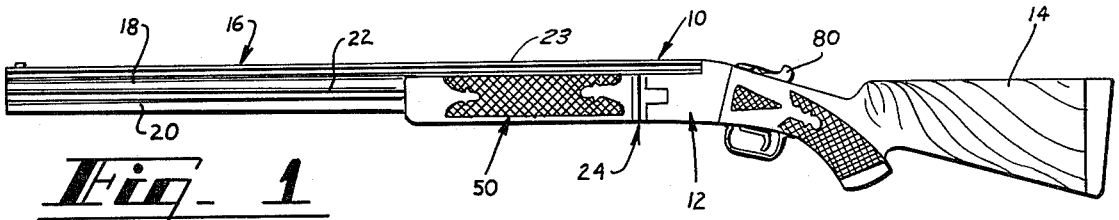
FIG. 1 is a side view of a shotgun constructed in accordance with the present invention.

The entire firearm 10 may be disassembled into components and comprises a frame 12 on which is mounted a detachable stock 14 which could also be a shorter stock, handgrip or the like. Removably attached to frame 12 is a barrel arrangement 16 comprising a pair of respective identical barrels 18, 20 mounted in co-extensive, juxtapositioned over-and-under relationship and welded or otherwise attached together along a common indented line 22 to provide a single unitary barrel assembly unit having a sight bar 23. The barrel arrangement 16 is mounted on the frame 12 by means of a detachable hinge arrangement 24.

Figure 10:
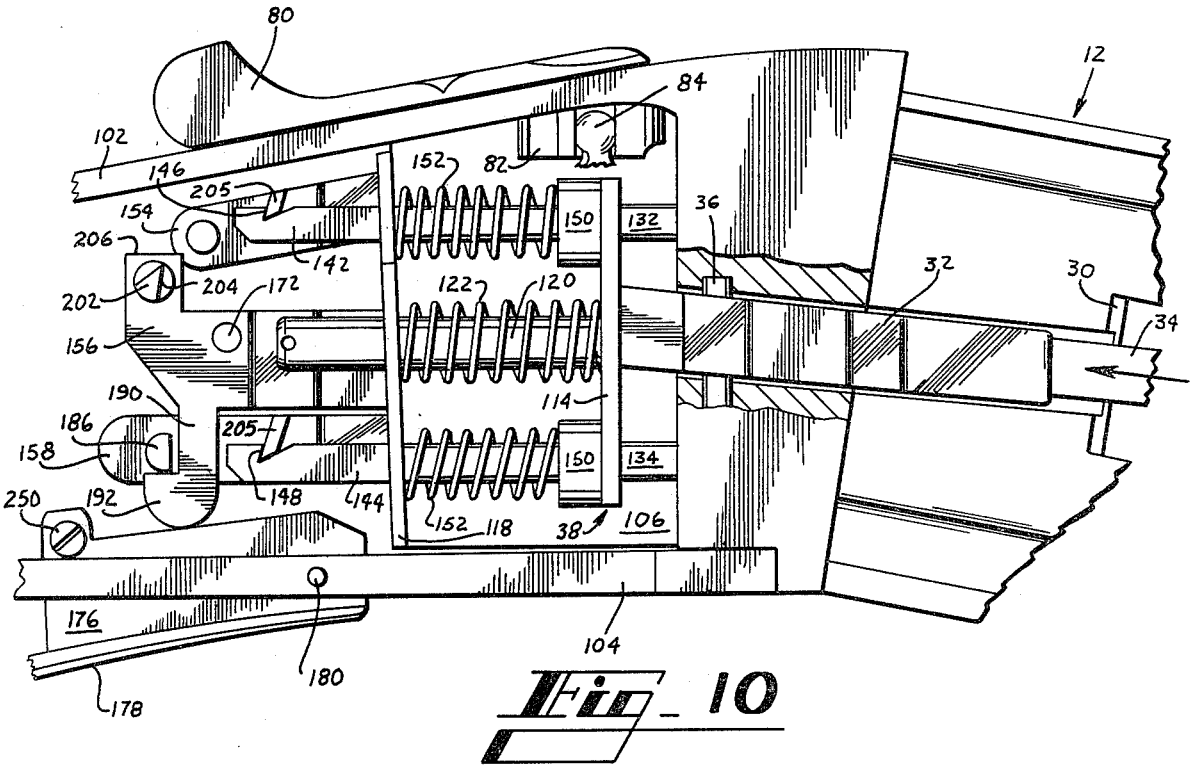
FIG. 10 is a side elevation view similar to the view in FIG. 9 showing the movement of the cocking lever upon opening of the barrels and illustrating both firing pins in cocked position but with certain outside elements omitted to show inside details.
Figure 12:
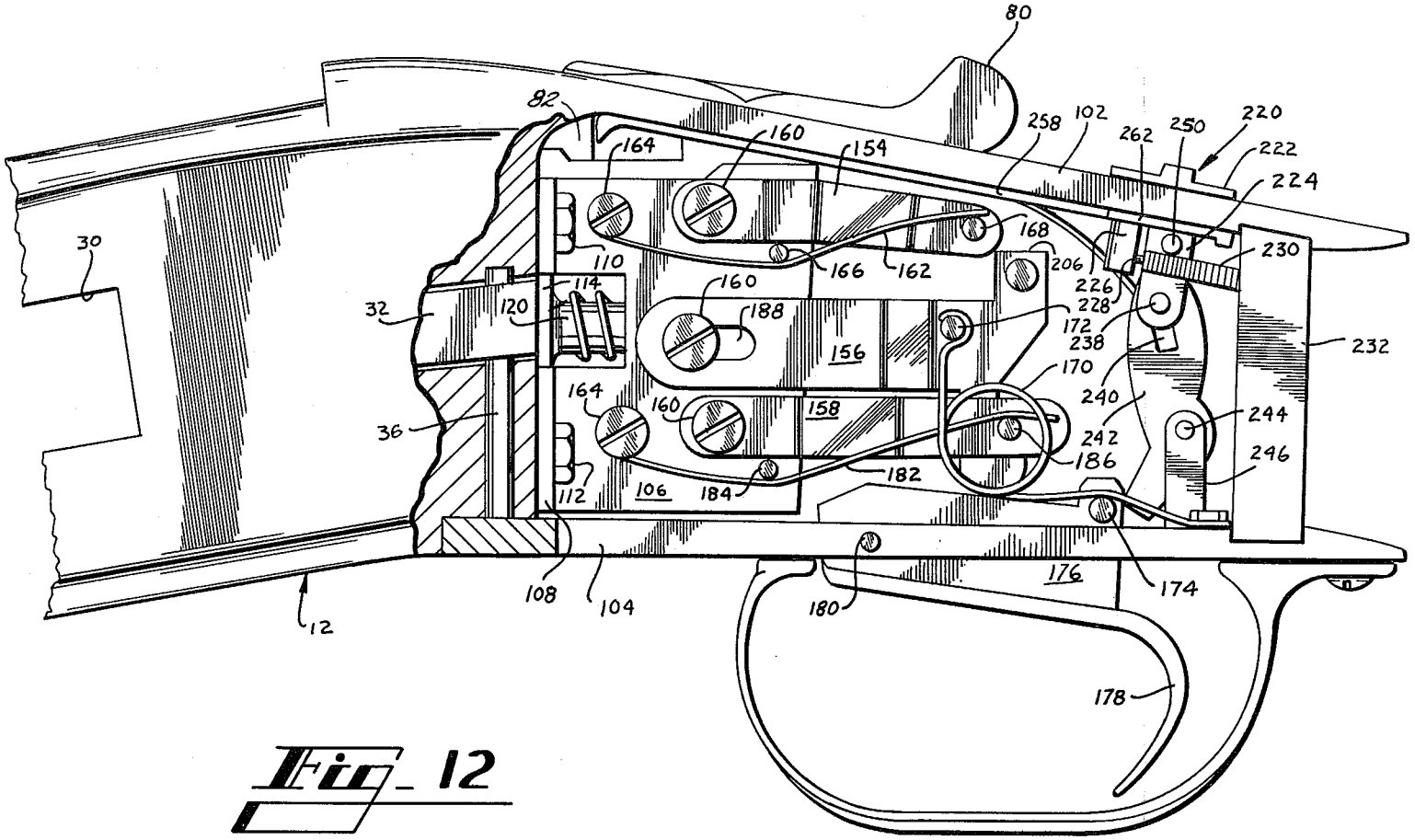
FIG. 12 is a side elevation view of the other side of the cocking mechanism from that shown in FIGS. 9–11.

Hinge arrangement 24 comprises a convex or cylindrical hinge portion 26 formed as part of the forward frame member 28 having a mounting slot 30 next to which there is mounted a cocking lever 32, which is engaged by a finger 34 mounted on the barrel arrangement 16 to travel therewith so that the manual opening of the barrel arrangement 16 about the hinge arrangement 24 moves the cocking lever 32 on its pivot pin 36 inserted in a hole in the solid portion of the frame 12, as seen in FIGS. 10 and 12. The cocking lever 32 engages and moves a firing pin cocking assembly 38 to be described hereinafter.

As seen in FIGS. 4 thru 8, inclusive, the barrel arrangement 16 includes a conventional movable double extractor 39 comprising an extractor plate 40 which is operated in conventional fashion to move outwardly with shaft 41 whenever the barrels are moved along the hinge arrangement 24 to engage and extract the empty shells automatically and mechanically rather than manually. This is a convenience found in most double guns and could of course be eliminated if one were willing to manually (finger) extract each of the shells.

Figure 5:
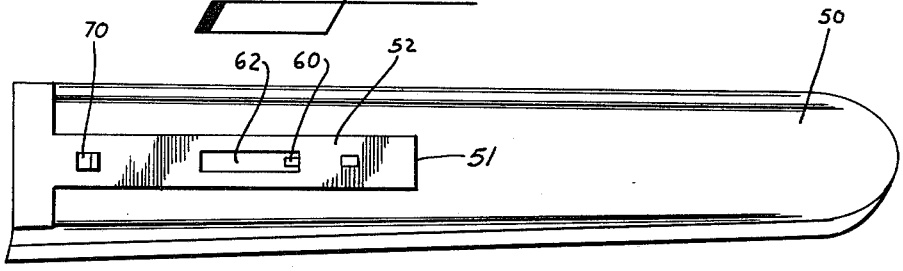
FIG. 5 is a plan view of the fore piece side stock and bracket.
Figure 6:
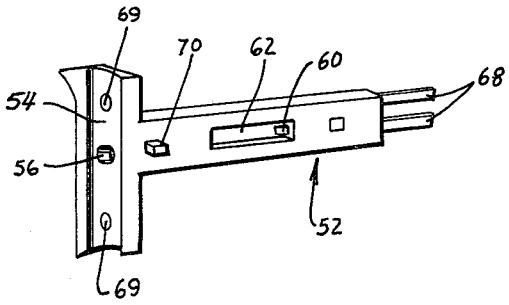
FIG. 6 is a detailed perspective view of the side forepiece bracket.
Figure 7:
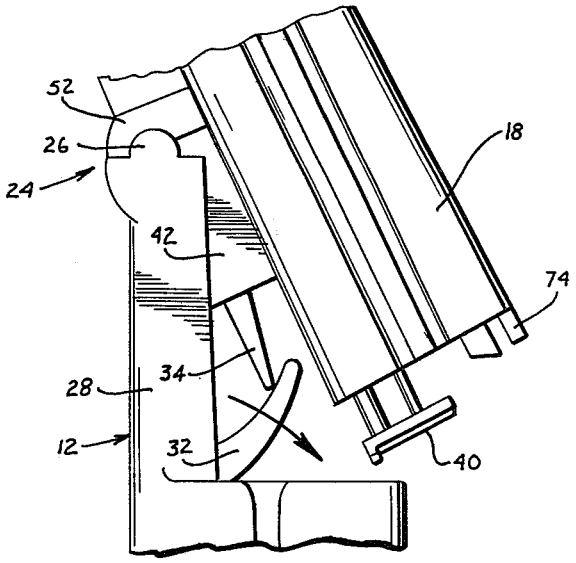
FIG. 7 is a top plan view of the mid-portion of the firearm opened to extract and load.

There is also a pair of spaced mounting lugs 42, 44 each having a respective notch 46, 48 for the purpose of holding the removable forestock piece 50 which, as seen in FIG. 5, has a cavity 51 therein receiving a removable mounting bracket 52 constructed of metal or the like and comprising on one end the open cavity or concave block 54 which is the other side of the hinge arrangement 24 and which includes a special hole 56 in which is mounted a movable, T-shaped projecting pin or tongue 58 on hinge portion 26 which fits into the hole 56 to hold the hinge arrangement 24 in assembled condition but to allow the forestock piece 50 and its bracket 52 to be detached and removed by means of a sliding latch member 60 projecting into a slot 62 in which is fitted the lug 44 so that latch member 60 fits into slot 48. Pin 60 is operated by means of a spring biased screw 64 mounted in a hole in the forestock piece 50. The bracket 52 is held in place by means of a pair of projecting pins 68 which are fitted into matching holes in the cavity in the front part of the forestock piece 50 and by screws in holes 69. A projecting lug 70 mounted on the mounting bracket 52 fits in a slot formed between the barrels 18, 20. Lug 42 fits into the slot 30 and snaps into place over a lip 71 on the inside of frame 28 to hold the hinge arrangement in assembled condition.

Figure 2:
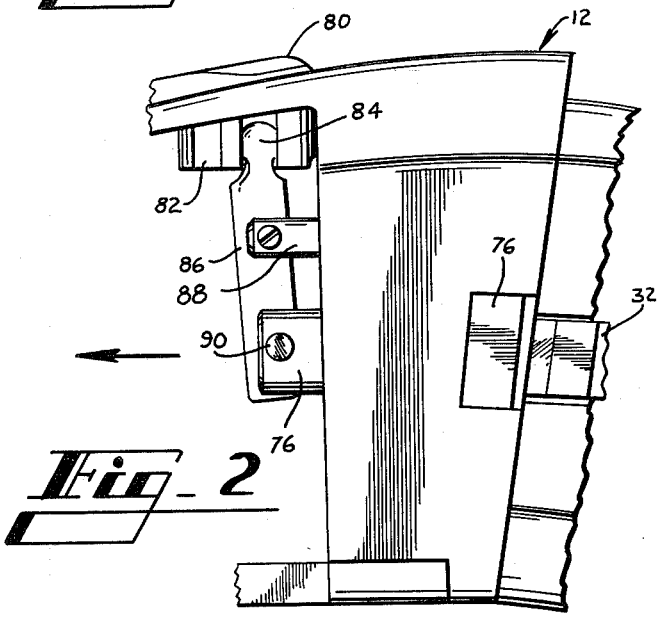
FIG. 2 is an enlarged side elevation view of the front portion of the frame showing the barrel locking device.
Figure 3:
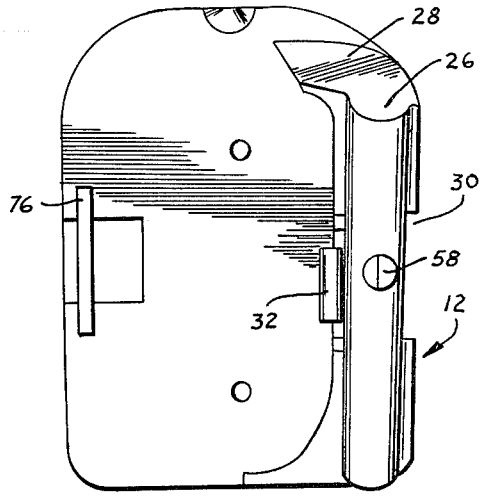
FIG. 3 is a rear elevation view of the inside of the frame portion showing one side of the hinge and the locking arrangement in FIG. 2.
Figure 8:
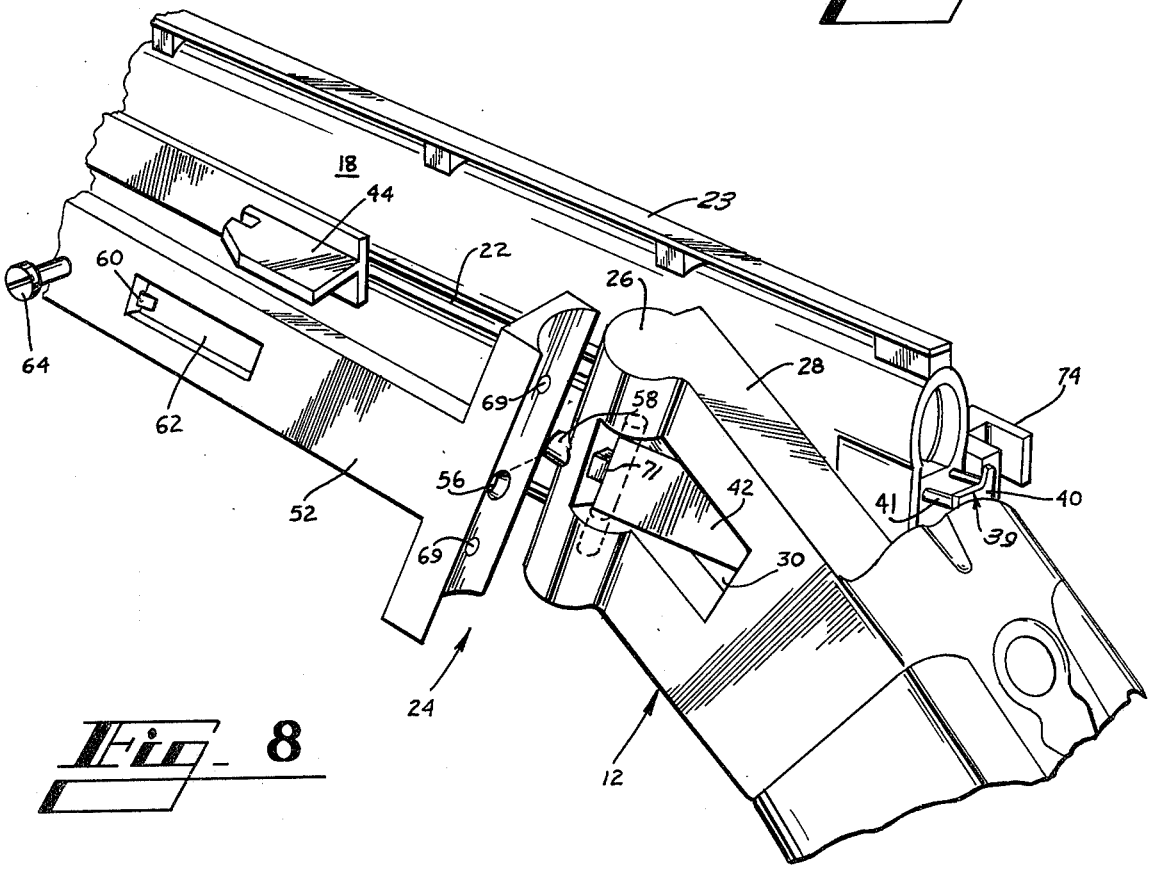
FIG. 8 is a perspective disassembled assembly view of portions of the barrel, frame and forepiece stock.
Figure 4:
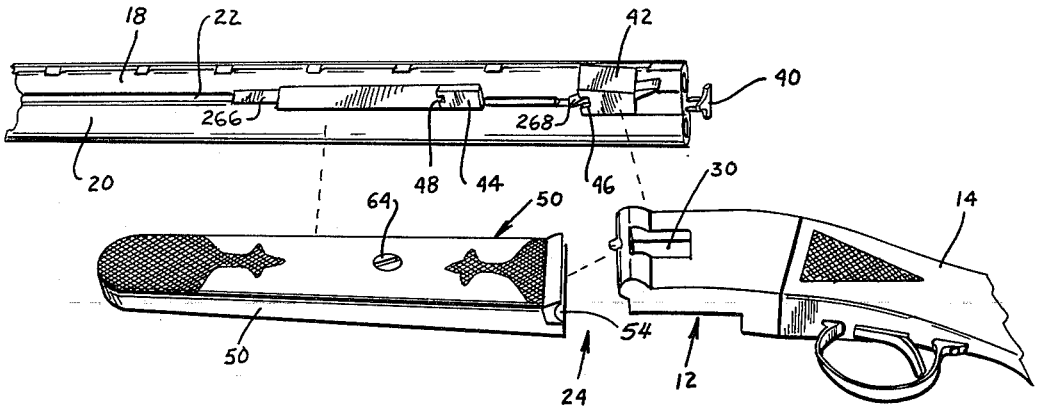
FIG. 4 is a disassembled perspective view of certain major components of the firearm shown in FIG. 1.

The barrel arrangement 16 is detachably latched in place by means of a slotted, fixed latch bracket 74 in which there is moved a retractable latch member 76 mounted in the slot in the solid frame 12 to be moved in a generally fore and aft direction (as seen in FIGS. 2 and 3) so as to be inserted in and removed from the slot in the bracket 74 upon manual actuation of a latching lever 80, which is pivotally mounted on the top of the frame 12, to operate a cam operator 82 having a cam opening therein in which is mounted the cylindrical head 84 of a latching lever 86 which is pivoted on a fixed member 88 intermediate the length thereof and is pivotally attached by pivot pin 90 to one end of the latching lever 76 to retract same. The closing of the barrel arrangement 16 manually causes the latching lever 76 to be moved back into the slot in the latch bracket 74 thereby tightly latching the barrel arrangement 16 in position on the frame 12 for firing after the fresh shells have been positioned and placed in the breech chambers at the end of each barrel 18, 20.

COCKING AND FIRING PIN ARRANGEMENT AND OPERATION

Figure 9:
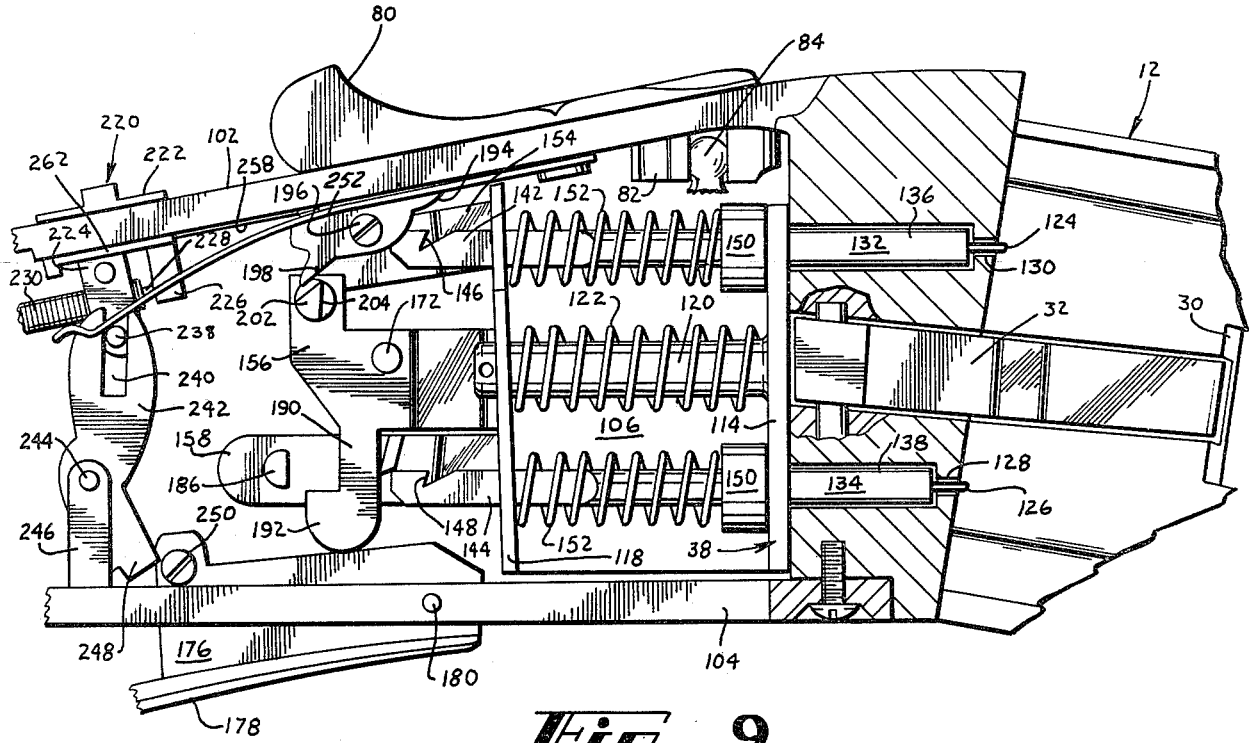
FIG. 9 is an open side elevation view of the frame showing the firing pin, cocking and releasing mechanism, prior to cocking.

The cocking and firing pin assembly 38 is readily seen on both sides in FIGS. 9 thru 16, inclusive, and is mounted in the space between the upper and lower frame members 102, 104 of the frame 12. An angular, fixed plate 106 has a front offset portion 108 which is attached by means of screws 110 to the frame 12 and plate 106 supports a movable cocking plate 114, as seen in FIG. 9 initially, which is moved toward an inwardly turned rear vertical plate portion 118 of the fixed plate 106 by means of the cocking lever 32. Cocking plate 114 has attached thereto a central shaft 120 about which is mounted a coil spring 122 which bears on and is confined by plate portion 118 whereby movement of plate 114 is against spring 122, as seen in FIG. 10.

A pair of respective firing pins 124, 126, normally horizontal in firing position, operate in a respective firing pin opening 130, 128 in the frame 12 and each respective firing pin 124, 126 is attached to a small cylindrical shaft 132, 134 mounted in respective cylindrical openings 136, 138 in the frame 12. The ends of shafts 132, 134 are attached to the cocking plate 114 and are operated as small plungers to withdraw the respective firing pins 124, 126 in the manner shown in FIG. 10.

Respective cylindrical shafts 132, 134 have attached thereto a respective firing pin lever 142, 144 each having a respective notch 146, 148. Each firing pin lever 142, 144 is essentially an extension of a respective firing pin shaft 132, 134 and a respective collar 150 on the end of each shaft 132, 134 confines a respective coil spring 152 against the fixed end 118 of the fixed plate 106 whereby there is a balanced pressure whenever the cocking lever 32 drives the cocking plate 114 rearwardly to the cocking position of both of the firing pins 124, 126.

Referring to the side shown in FIG. 12, there are three respective pivoted levers 154, 156 and 158 which are pivotally attached by respective screws 160 to the fixed plate 106. Levers 154, 158 correspond in operation to a respective upper and lower firing pin lever 142, 144 and lever 156 is an intermediate control lever for both. An elongated spring 162 has one end attached by screw 164 on plate 106 and passes over a pin 166 and thence is bent around a projecting pin 168 on lever 154.

Another elongated spring 170 has one end bent around a pin 172 on lever 156 and is bent 360° and thence extends across a pin 174 projecting from trigger plate 176 on which is mounted a curved trigger 178 which is pivoted on a pivot pin 180. The spring 182 for lever 158 is attached in place on plate 106 by a screw 164 and is bent beneath a projecting pin 184 and thence around a projecting pin 186 attached to lever 158. Spring 170 acts on lever 156 to bias same downwardly and also acts on trigger plate 176 to resist the movement of trigger 178 and to return same when released.

Lever 156 is provided with a slot 188 and carries a depending actuating portion 190 having a circular bottom edge 192 which is on top of and engages the top edge of the trigger plate 176 to be actuated thereby upon the operation of the trigger 178 about the pivot 180 and against the spring 170 which tends to keep the trigger plate 176 in downward position and to resist the upward movement thereof.

Figure 11:
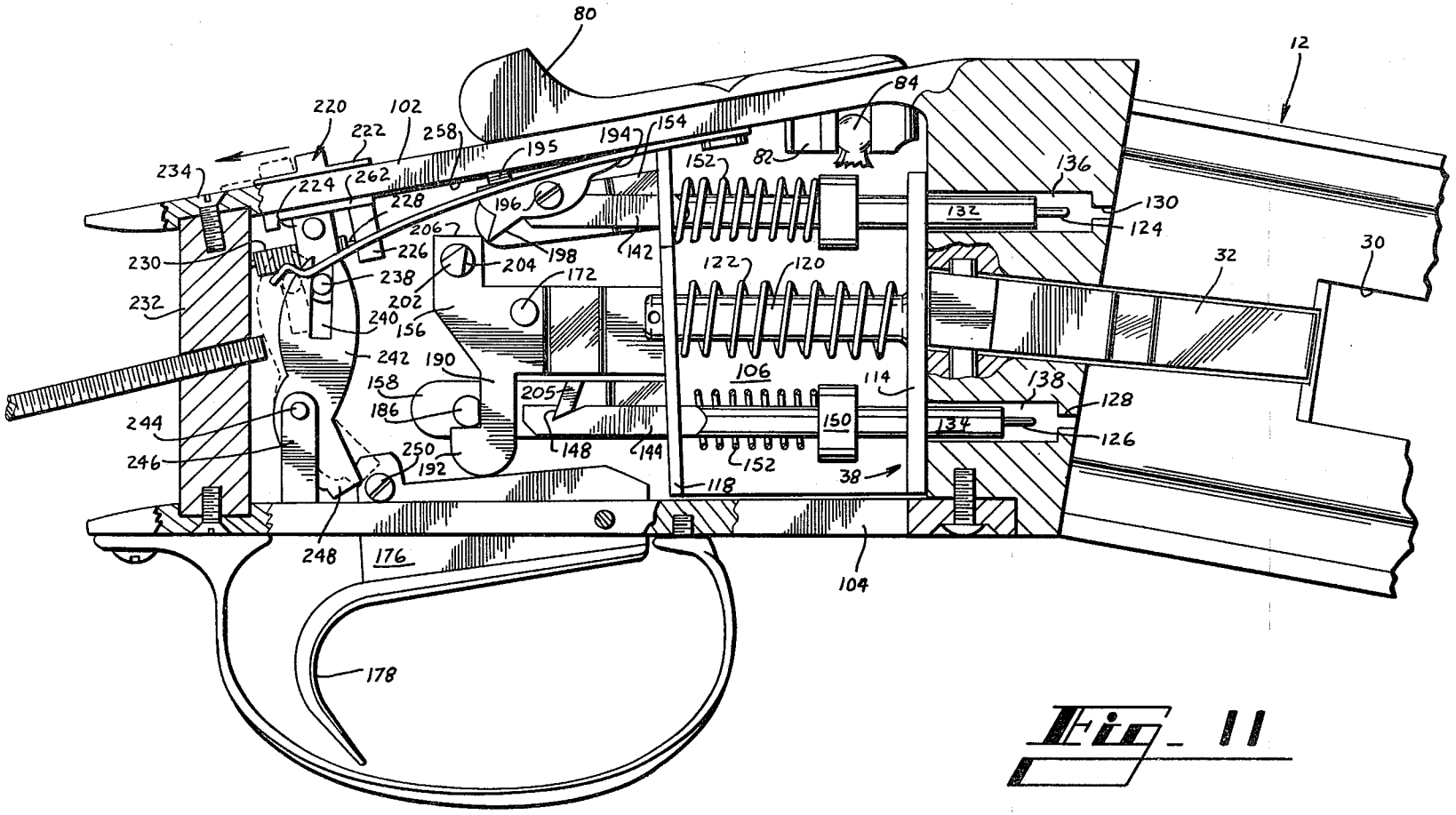
FIG. 11 is a side elevation view similar to FIGS. 9 and 10 but with the omitted parts of FIG. 10 shown in full lines and part of the frame broken away.
Figure 13:
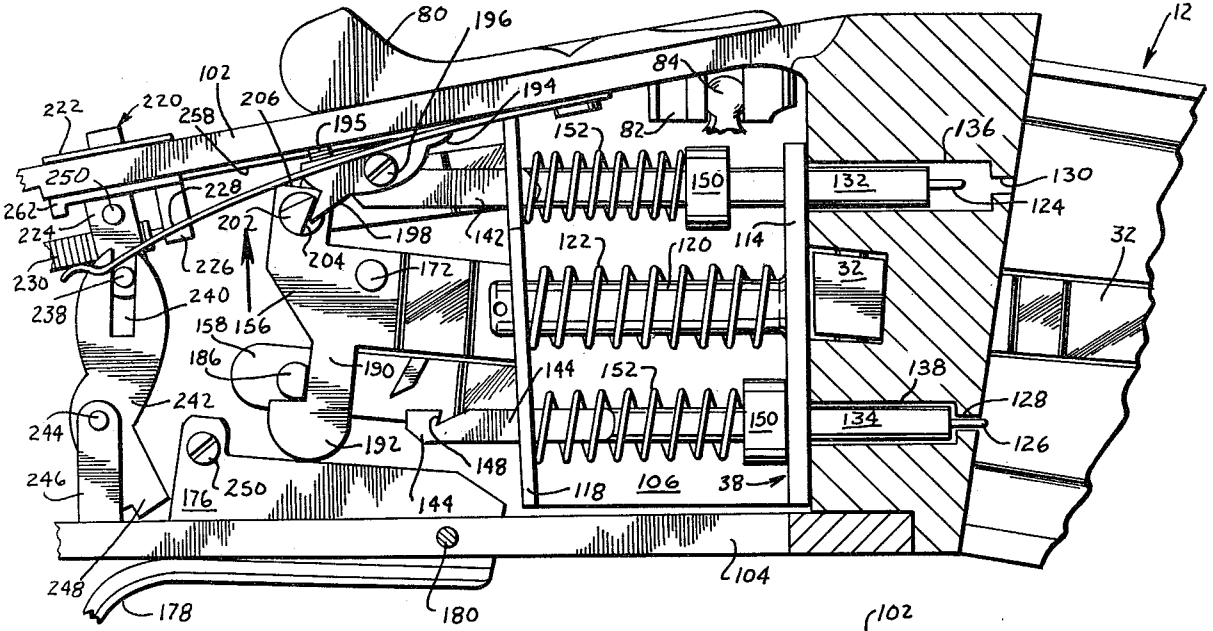
FIG. 13 is a side elevation view similar to and of the same side as FIGS. 9–11 and with the lowermost firing pin released and the trigger still in raised position.
Figure 14:
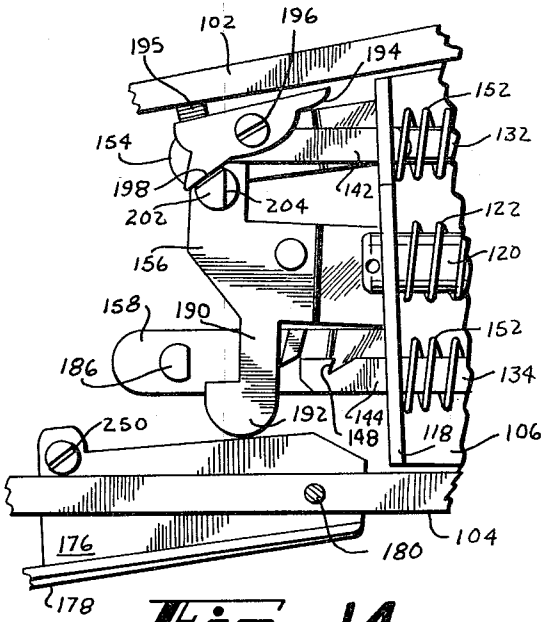
FIG. 14 is a side elevation view of part of the mechanism shown in FIG. 13 after the trigger has been released the first time and prior to releasing the second and uppermost firing pin and illustrating how said firing pin is prevented from release.

A pivoted plate 194 attached in place by a pivot screw 196 and operating against a small coil spring 195 confined against frame member 102 has a projecting tooth 198 (as seen in FIG. 9, 11 and 14). The top of lever 156 has a projecting stop member 202 which has opposed flat surfaces 204 to be engaged by tooth 198 upon the lifting of the plate 156 to the position in FIG. 13 to prevent the firing of the upper firing pin 24 until the trigger has been operated twice in succession in order to fire selectively first the lower firing pin 126 and then the upper firing pin 124.

Each lever 154, 156 has a respective tooth member 205 which, upon driving the cocking plate against the springs 122, 152 rearwardly from the position of FIG. 9 to the position of FIG. 10, engages in the respective notches 146, 148 to latch the respective firing pins 124, 126 into latched firing position shown in FIG. 10 after the barrel arrangement 16 has been opened and then closed to operate the cocking lever 32 against the cocking plate 114.

In the cocked position of both pins 132, 134 shown in FIG. 10, the trigger 178 and trigger plate 176 is in a downward position against the bottom edge 204 of the portion 190 of plate 156 and the firearm 10 is ready to be fired. This is the same position shown in FIG. 11 in which it is seen that the tooth 198 is away from and in front of the edge 204 which has been moved to a rearward position. The top edge of the portion 190 is against the pin 186 on the lever 156 and in position to lift lever 158 about its pivot screw 160 thereby disengaging the toothed member 204 from the notch 148 thereby releasing the firing pin 126 for firing.

The action of lifting the portion 190 lifts the plate 156 to cause the flat surface 204 to engage the flat surface of tooth 198 in the manner shown in FIG. 13 thereby preventing the firing pin lever 142 from moving upwardly or forwardly which prevents the upper firing pin 124 from firing until after the trigger 178 has been released and raised for a second time. In the position of FIG. 13 the flat surface 204 is engaged with a tooth 198, the lower firing pin 126 has been fired and the upper firing pin 124 is cocked and ready to be fired having never been released from the position shown in FIGS. 10 and 11. In order to fire the upper pin 124 it is necessary to move the pin 202 off the tooth 198 and to lift the lever 154 so that the tooth 204 is disengaged from the notch 146.

Figure 15:
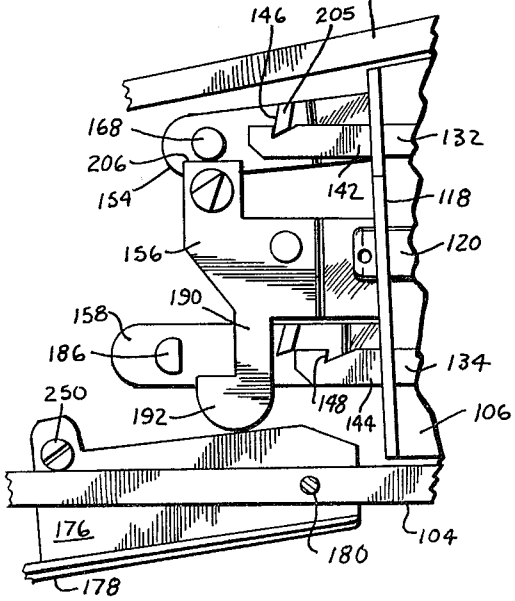
FIG. 15 is a side elevation view of the mechanism shown in the position of FIG. 14 (i.e. second pin not fired) but with certain parts omitted to show inside details.
Figure 16:
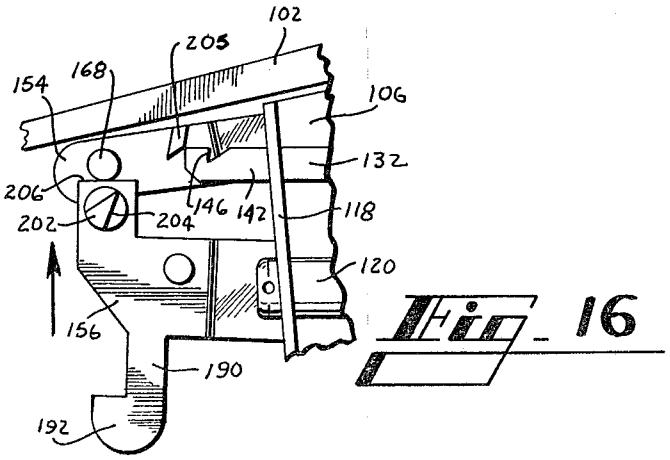
FIG. 16 is a side elevation view of part of the mechanism shown in FIG. 14 illustrating how the second motion of the trigger releases and fires the uppermost firing pin.

Upon releasing the trigger from the upward position shown in FIG. 13 after firing the lower firing pin 126, the lever 156 drops down in response to the spring pressure from spring 170 as the edge 192 moves downwardly along the edge of plate 176 and the tooth 198 is disengaged from the hold position in FIG. 13 and the stop member 202 moves beneath and forwardly of the tooth 198 which enters in the direction toward the end of the barrel to assume the position of FIGS. 14 and 15 in which the trigger is ready to be pulled again to fire the upper firing pin 124. In FIG. 15 it is seen that the top edge 206 of lever 156 is positioned directly against the pin 168 on lever 154 ready to lift lever 154 to disengage the tooth 205 from the corresponding notch 146. It is noted that upon firing the lower pin from the position shown in FIG. 10 the cocking plate 114 had already moved forwardly back to initial, normal position against the inside face of a portion of the frame in the manner shown in FIGS. 9 and 13 and ready to be again cocked by movement of the cocking lever 32 upon opening of the barrel arrangement 16 in the manner previously described.

A safety device designated generally by reference numeral 220 comprises a finger operated safety slide button 222 which is slidably mounted on top of frame member 102 to operate a shifting lever member 224 which is also operated as an automatic safety, to be described later comprising a spring block 226 against which is interposed a spring plunger 228 mounted within a coil spring 230 against a frame block 232 attached between frame members 102, 104 by means of attaching screws 234. Shifting lever member 224 carries a fixed projecting pin 238 mounted in a slot 240 on a toggle lever 242 pivotally mounted by pivot 244 on a fixed support member 246 mounted on bottom frame member 104. The lower end 248 of toggle lever 242 is shifted to bear against an enlarged, screwhead 250 of the projecting pin 174 attached to the upper portion of trigger plate 176 so that the trigger plate 176 cannot move. An elongated spring member 252 has one end attached by screw 254 to upper frame member 102 and extends and bends around the top and over the projecting pin 238 thereby spring biasing trigger plate 176 to resist upward movement and to urge downward movement.

AUTOMATIC SAFETY

The safety 220 is automatic in that opening the action (cocking the firing pin 124, 126) automatically engages the safety 220 into a safe position in which it remains until the finger button 222 is manually actuated. The movement of latching lever 80 to open the action causes the cam operator 82, in addition to the actuation of the latching lever 80, to slide a safety slide bar member 258 to move the block 226 against spring 230 locking the safety. A small projecting pin 250 catches an actuating portion 262 of the slide bar member 258 which is operated by the manual safety slide button 222 to disengage the safety for firing. The spring 230 and plunger 228 keeps the safety bar member 258 under pressure and tension until it is manually released.

The extractor shaft 41 is spring loaded by a spring 266 when the barrel arrangement 16 is closed and when the barrel arrangement 15 is open the spring 266 is released by a control member 268 to spring release the extractor 40 and throw the shells clear.

While I have shown and described a particular embodiment of this firearm this is by way of illustration and there are various alterations, changes, modifications, deviations, eliminations, substitutions, additions, and departures which may be made in the embodiment shown without avoiding the scope of the invention as defined only by a proper interpretation of the appended claims.

I claim:

1. In a firearm, a normally stationary firearm frame having a projecting hinge portion thereon, an integral barrel assembly comprising a pair of superposed, coextensive barrels mounted in over and under relationship, said barrels both normally being upright in firing position, attaching means on one side of said barrels attaching said barrels to said projecting hinge portion about a normally, substantially vertical hinge line whereby said barrels open to one side for loading and unloading, said attaching means comprising an attaching member having a notch and said frame having a slot therein to receive a portion of said attaching member, there being a lip on said frame member which fits into said notch when said barrel assembly and said frame are assembled, a bracket member removably attached to said barrel assembly and having a concave hinge portion thereon engageable with a complementary convex portion of said hinge on said frame, and a lug member projecting from said hinge portion on said frame and said concave portion on said bracket having an opening therein into which said lug fits when said hinge is assembled.

2. A firearm:

a firearm frame having a first hinge portion thereon, said frame having a space formed on one side thereon providing a space in which is received the ends of over and under barrels in over and under relationship, a barrel assembly comprising a pair of coextensive, integral over and under barrels normally fired in substantially vertical position and having open ends to receive cartridges therein, means detachably attaching said barrel assembly to said frame, a hinge portion on said projecting frame portion, whereby said barrel open ends are closed by said frame in firing position, said hinge moving about a normally, substantially vertical axis when said barrels are upright, a second hinge portion mounted on said barrel assembly, both of said hinge portions normally extending substantially vertical when said barrels are in normal vertical firing position, means detachably connecting said first and second hinge portions and other means detachably and movably connecting said barrel assembly on said frame hinge portion whereby said barrels may be moved a limited distance outwardly from said frame portion for loading and unloading said firearm, said frame having a frame slot therein, said barrel assembly having a projecting lug member thereon inserted into said frame slot to assemble the hinge, and a small projecting member on said frame adjacent the frame slot and a small hole in the second hinge portion into which the projecting member fits when the hinge is assembled.

3. The device in claim 2:

wherein a concave hinge portion on said barrel assembly is engageable with a complementary, convex portion of said hinge on said frame, and a lug member projecting from said hinge portion on said frame and said concave portion on said barrel assembly having an opening therein into which said lug fits when said hinge is assembled.

* * * * *